US009669269B2

(12) United States Patent
Hart

(10) Patent No.: US 9,669,269 B2
(45) Date of Patent: Jun. 6, 2017

(54) AUTOMATIC BALL FEEDER FOR A PITCHING MACHINE

(71) Applicant: Tom Hart, Fenton, MO (US)

(72) Inventor: Tom Hart, Fenton, MO (US)

( * ) Notice: Subject to any disclaimer, the term of this patent is extended or adjusted under 35 U.S.C. 154(b) by 0 days.

(21) Appl. No.: 14/073,786

(22) Filed: Nov. 6, 2013

(65) Prior Publication Data

US 2015/0122240 A1 May 7, 2015

(51) Int. Cl.

| | |
|---|---|
| ***A63B 47/00*** | (2006.01) |
| ***A63B 102/18*** | (2015.01) |
| ***A63B 69/40*** | (2006.01) |
| ***A63B 24/00*** | (2006.01) |

(52) U.S. Cl.

CPC ..... *A63B 47/002* (2013.01); *A63B 24/00* (2013.01); *A63B 69/406* (2013.01); *A63B 2047/004* (2013.01); *A63B 2102/18* (2015.10); *A63B 2102/182* (2015.10); *A63B 2220/62* (2013.01); *A63B 2220/64* (2013.01)

(58) Field of Classification Search

CPC ..... F41B 7/00

USPC ..... 124/48, 78, 16, 50, 41.1, 10; 473/451, 473/422, 431

See application file for complete search history.

(56) References Cited

U.S. PATENT DOCUMENTS

| | | | | |
|---|---|---|---|---|
| 3,120,669 | A * | 2/1964 | Montuori | 15/97.1 |
| 5,520,171 | A * | 5/1996 | David | 124/51.1 |
| 5,544,642 | A * | 8/1996 | Guthrie | 124/62 |
| 2004/0087390 | A1* | 5/2004 | Mauer et al. | 473/417 |
| 2011/0083654 | A1* | 4/2011 | Galinson | 124/59 |
| 2012/0037138 | A1* | 2/2012 | Huebl | 124/56 |

* cited by examiner

*Primary Examiner* — Gene Kim
*Assistant Examiner* — Jeffrey Vanderveen
(74) *Attorney, Agent, or Firm* — CreatiVenture Law, LLC; Dennis JM Donahue, III

(57) ABSTRACT

A game ball feeder for delivering balls to a game ball throwing machine. The game ball feeder includes a base, a support frame attached to the base, a drive mechanism attached to the support frame, and a support rod attached to the support frame. A rotatable ball housing operatively engages the support rod, is mounted in a substantially horizontal configuration, and includes a plurality of cylindrical shaped ball holding sections. Each ball holding section can include a wall defining an entry opening and an exit opening with the entry opening positioned vertically higher than the exit opening. A transfer path can be operatively attached to a support frame and aligned to accept a ball from one of the exit openings. Further, a ball indexing element can be shaped and positioned to control the movement of the balls within at least one of the ball holding sections.

10 Claims, 9 Drawing Sheets

SECTION A-A

AUTOMATIC BALL FEEDER FOR A PITCHING MACHINE

This is a is a Non-Provisional Utility Patent Application for the disclosure of an "AUTOMATIC GAME BALL FEEDER."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: NONE

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE DISCLOSURE

The present disclosure relates generally to devices that launch or throw sports balls. More particularly, the current disclosure relates to an automatic game ball feeder for delivering balls to a game ball throwing machine.

There are machines used in numerous sports. These range from equipment to maintain the surface on which the sport is played and includes machines that assist during the playing of a sport. One example of machines aiding in the playing and/or participation of a sport includes the use of game ball throwing machines. These machines are used to throw or launch the ball used in a particular sport.

For example, in a vast number of sports, such as football, tennis, soccer, cricket, basketball, lacrosse, baseball, and softball, machines are used to launch or throw a ball in the air to facilitate the movement of that ball as it would naturally occur during the playing of that sport. For example, in tennis, tennis ball machines are used to send balls to players during practice so they can work on their game techniques. In American football, football throwing machines are used to simulate either a quarterback's throw to allow receivers to practice catching the ball. This general concept of using machines to simulate the movement of a ball permeates most sports.

One sport in particular, diamond sports such as baseball and softball, have a type of machine generally referred to as a pitching machine. This pitching machine is a game ball throwing machine that is used to simulate the throw of a ball by a pitcher. These machines are typically used in batting practice but can also be used to simulate a pitched ball for a catcher or a hit ball from a batter to assist players in the field to work on various fundamentals. In fact, in some instances, pitching machines are sanctioned for game use and are even required by youth level diamond sports leagues to be used as a substitute for a live pitcher in the actual competitions.

Typically, these pitching machines have conventionally required a person, such as another player or coach, to stand beside the machine and manually feed balls into the machine one at a time. This practice has evolved to the implementation of automatic ball feeders. Most of these conventional automatic ball feeders consist of one of two forms. The first is a single line of balls suspended above the pitching machine that releases balls. This release is either by some type of interval or timing or by activation by a player or user of the pitching machine. These lines of balls may have a bend, or turn, or can alternately be formed into a spiral, in order to reduce the overall size of that automatic feeder.

Other prior art automatic ball feeders have large containers, or hoppers, where all of the balls to be fed into the pitching machine are kept. These and other vertical storage ball hoppers, or bins, have disadvantages due to the friction caused by the weight of the balls when those bins are full. The balls on the middle and top layers in those bins will press down and cause large amounts of friction to the balls on the bottom of those bins. The balls on the bottom are typically in the location that the balls are actually pulled from in order to feed the machine. With this additional friction, jams and stoppages in the ball feed are common, resulting in no balls being sent to, and pitched by, the pitching machine connected to the automatic feeder. These jams and delays and lags in pitching can cause frustration with the players trying to improve their skills, coaches and players operating the equipment, and observers. Additionally, the jams have a potential for injury if and when the balls become dislodged and break free from their jam—possibly sending multiple balls to and then out of the pitching machine at approximately the same time. Additionally, the safety concern arises when a user or a coach attempts to unjam those automatic feeders.

What is needed then is an improved game ball feeder for delivering balls to a game ball throwing machine. This improved game ball feeder preferably has multiple ball capacity and is designed to avoid jams and restricted ball flow that is prevalent in prior art ball feeding machine. This needed game ball feeder is lacking in the art.

BRIEF SUMMARY OF THE DISCLOSURE

Disclosed herein is a game ball feeder for delivering balls to a game ball throwing machine. The balls include two hemispheres and the game ball feeder is generally connected to a game ball throwing machine. The game ball feeder includes a base, a support frame attached to the base, a drive mechanism attached to the support frame, and a support rod attached to the support frame. Further, a rotatable ball housing operatively engages the support rod, is mounted in a substantially horizontal configuration, and includes a plurality of cylindrical shaped ball holding sections. Each ball holding section can include a wall defining an entry opening and an exit opening. The entry opening can be positioned vertically higher than the exit opening and both openings can be shaped and sized to accept and pass at least one of the balls. A transfer path can be operatively attached to a support frame and aligned to accept a ball from one of the exit openings and direct that ball to the game ball throwing machine. Further, a ball indexing element can be shaped and positioned to control the movement of the balls within at least one of the ball holding sections.

Each ball holding section can include a ball holding section axis wherein the ball holding section axis is substantially parallel to the ball holding section axis of adjacent ball holding sections. Further, the each of the ball holding section axis can be substantially parallel to the support rod. The support rod can suspend the ball housing from the support frame and the ball housing can rotate about the support rod. A gear can be operably attached to the rotatable ball housing and the drive mechanism. The drive mechanism and the gear can rotate the rotatable ball housing about the support rod.

The game ball feeder can include a reduced friction plate attached to the support frame. The plate can include a ball passage aligned with the transfer path wherein the ball passage is shaped to allow movement of at least one of the balls from one of the exit openings to the transfer path. Further, the plate can be shaped and position to restrict movement of balls from the remainder of the exit openings of other ball holding sections.

Each ball holding section can include at least one ball indexing element. Each ball indexing element can include a first aperture positioned in the wall proximate to the exit opening. The first aperture can be sized and shaped to only accept a portion of one of the hemispheres of one of the balls. This can restrict the movement of that ball within that ball holding section. Further, each ball indexing element can include a second aperture positioned in the wall axially closer to the entry opening than the first aperture and on a portion of the wall approximately opposite the first aperture. The second aperture can be sized and shaped to only accept a portion of one of the hemispheres of one of the balls and restrict the movement of that ball within that ball holding section.

It is therefore a general object of the present disclosure to provide a game ball feeder for delivering balls to a game ball throwing machine.

Another object of the present disclosure is to provide an improved game ball feeder that resists jams.

Still another object of the present disclosure is to provide an automated game ball feeder.

Yet still another object of the present disclosure is to provide an automated game ball feeder that reduces friction in the movement of the balls within the feeder.

Other and further objects, features and advantages of the present disclosure will be readily apparent to those skilled in the art upon reading of the following disclosure when taken in conjunction with the accompanying drawings.

DETAILED DESCRIPTION OF THE DISCLOSURE

Figure 1:
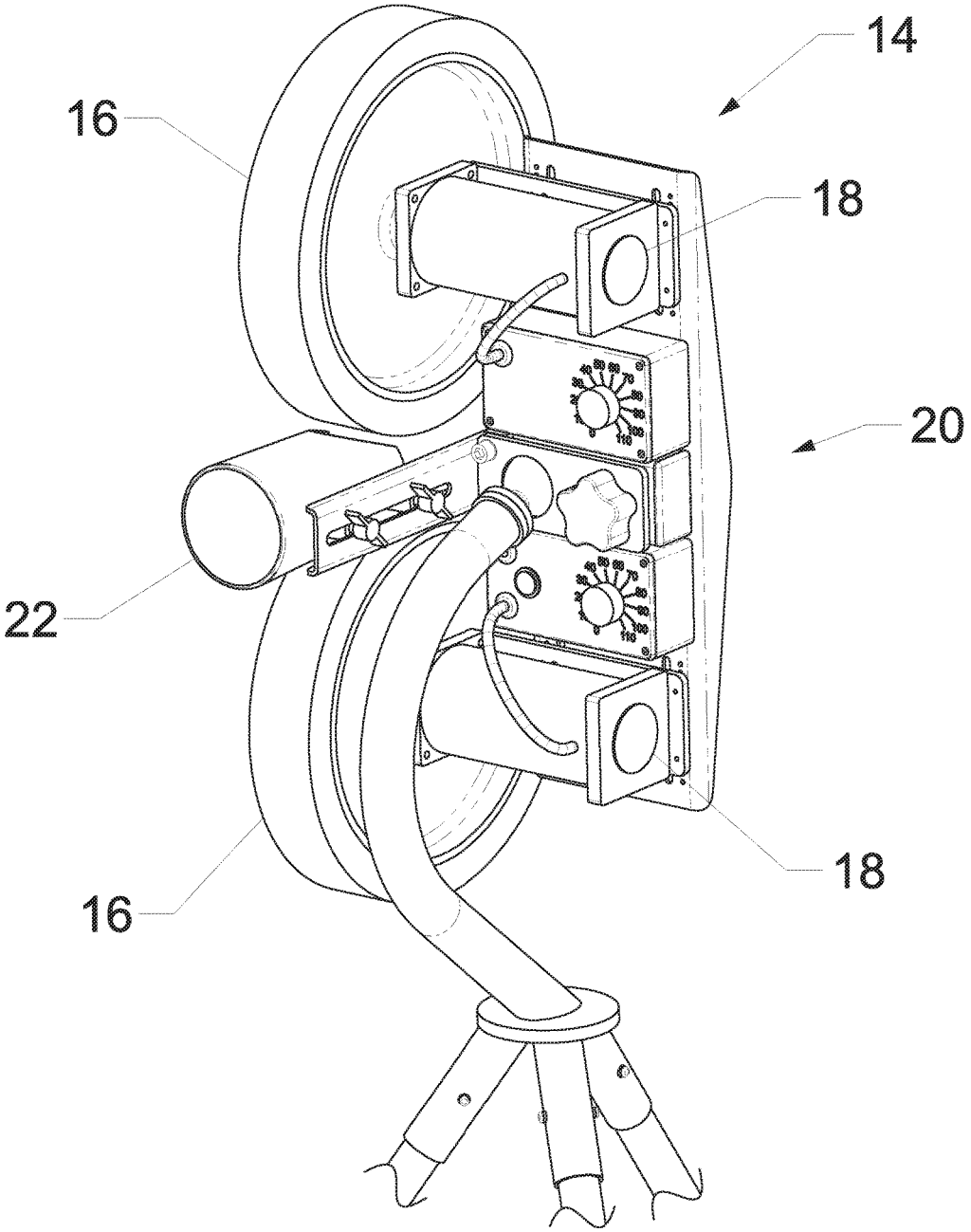
FIG. 1 is a perspective view of a game ball throwing machine.
Figure 2:
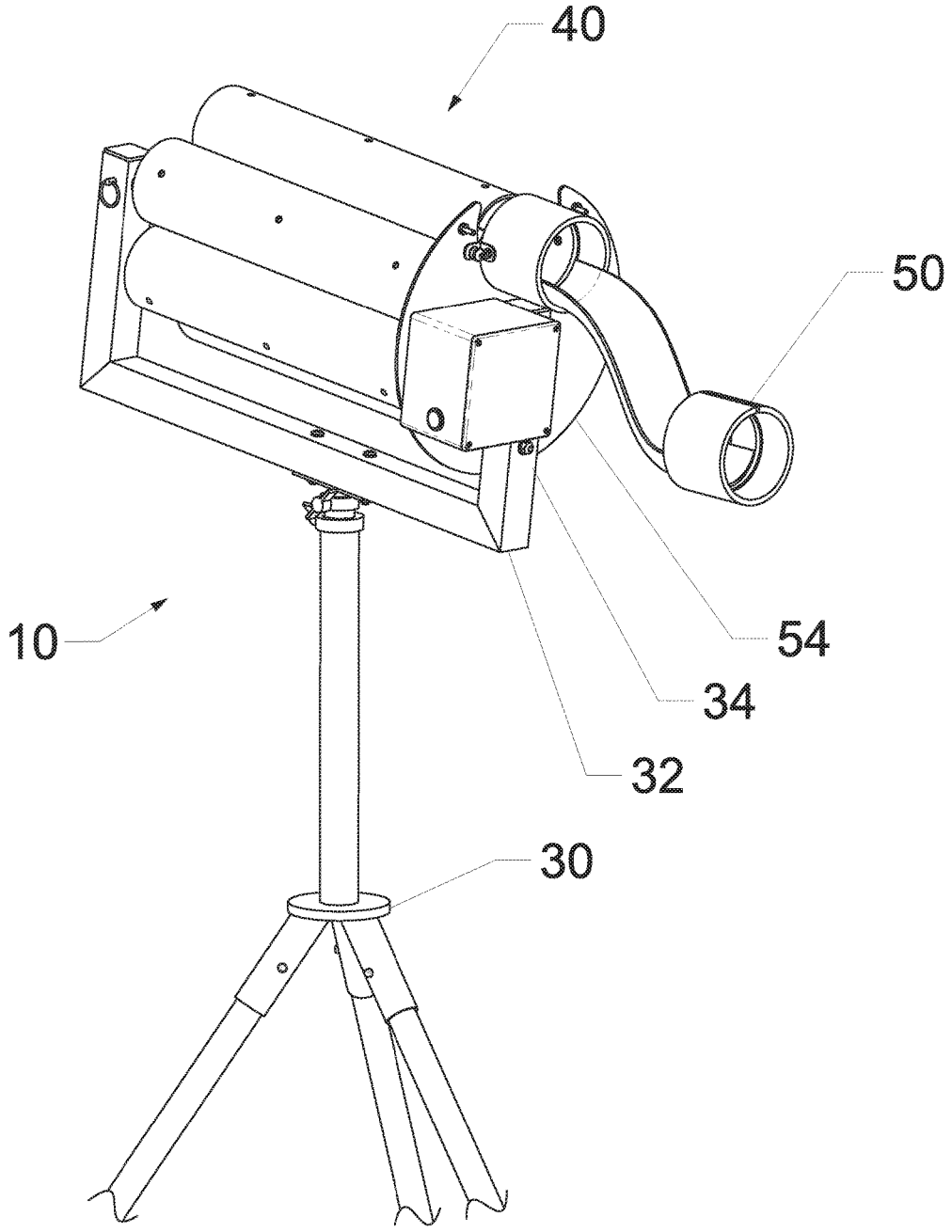
FIG. 2 is a perspective view of a game ball feeder made in accordance with the current disclosure.
Figure 3:
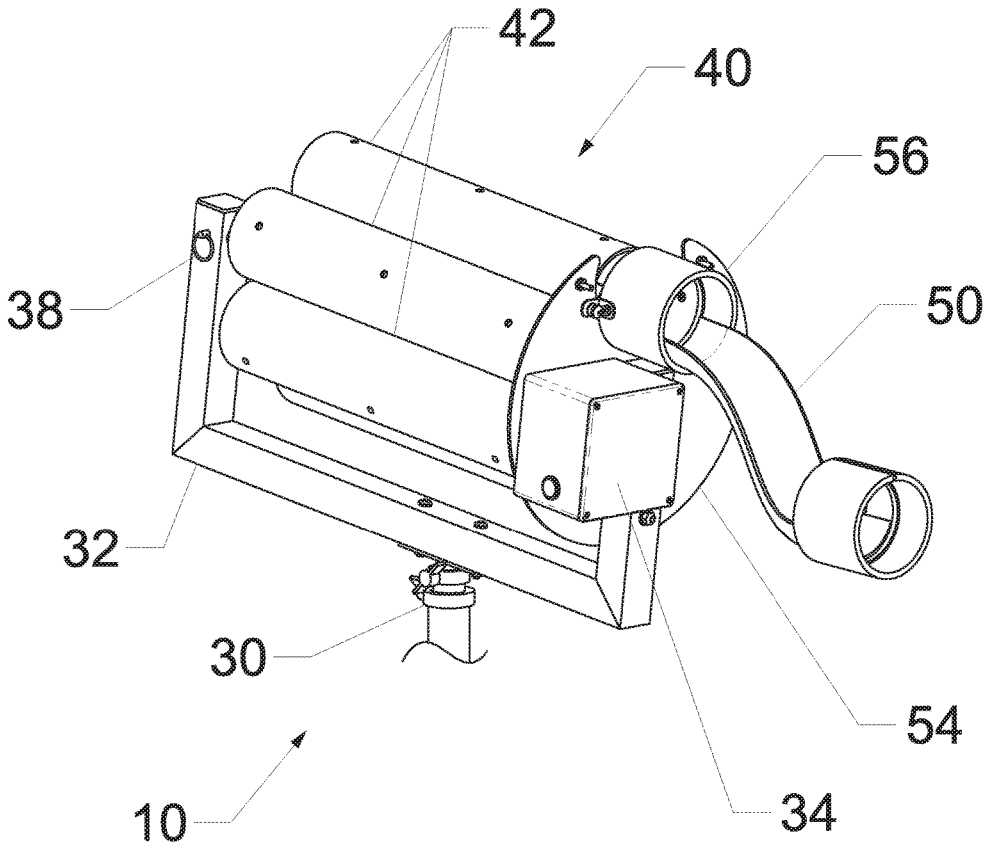
FIG. 3 is another perspective view of a game ball feeder made in accordance with the current disclosure.

Referring generally to the figures, a game ball feeder is shown and generally designated by the numeral 10. The game ball feeder 10 is for delivering balls 12 to a game ball throwing machine 14. As shown, the game ball throwing machine 14 is a diamond sport ball throwing machine, such as for baseball or softball. Other throwing machines can be utilized, such as those for soccer, football, lacrosse, cricket, basketball, and the like, and are contemplated by this disclosure.

In diamond sports, the game ball throwing machine 14 is generally described as a pitching machine. For simplicity's sake that term will be used forward. The pitching machine 14 generally includes wheels 16 that spin and are used to impart force to the ball to project the ball towards a target. The wheels are driven by motors 18 which are adjusted and controlled by a series of controls 20. The pitching machine 14 has an intake opening 22 positioned and sized to receive a ball 12 and deliver that ball 12 to the wheels 16 for the pitching machine 14. The game balls 12 typically have two hemispheres 24 wherein each hemisphere 24 is engaged by one of the wheels 16 to impart the force to propel the ball 12 to its target.

In a preferred embodiment, the game ball feeder 10 includes a base 30, a support frame 32 attached to the base 30, a drive mechanism 34 attached to the support frame 32, and a support rod 36 attached to the support frame 32. The base 38 can be a base as known in the art that allows for height adjustment of the game ball feeder 10. The support frame 32 is designed to support and stabilize the various aspects of the game ball feeder 10 as are above the base 30. The support rod 36 can be attached at one or more ends of the support frame 32, whereby the support rod 36 can be end supported or cantilevered from the support frame 32 as desired. The drive mechanism 34 can be those drive mechanisms known in the art, including various types of motors that can run off AC power, DC power, or both, as desired.

The ball feeder 10 further includes a rotatable ball housing 40 mounted in a substantially horizontal configuration and operatively engaging the support rod 36. The housing 40 can include a plurality of cylindrical shaped ball holding sections 42 where each ball holding section 42 includes a wall 44 defining an entry opening 46 and an exit opening 48. The entry opening 46 can be positioned vertically higher than the exit opening 48 and both openings can be shaped and sized to accept and pass at least one of the balls 12. A transfer path 50 can be operably attached to the support frame 32 and aligned to accept a ball 12 from one of the exit openings 48 and direct that ball 12 to the game ball filling machine 14. A ball indexing element 52 can be shaped and positioned to control the movement of the balls 12 within at least one of the ball holding sections 42.

The ball feeder 10 can include a reduced friction plate 54 that is attached to the support frame 32. The plate can include a ball passage 56 that is aligned with the transfer path 50. The ball passage 56 can be shaped to allow movement of at least one of the balls 12 from one of the exit openings 48 to the transfer path 50. The plate can be further shaped and positioned to restrict movement of the balls 12 from the remainder of the exit openings 48 of the other ball holding sections 42. This plate 54 can be designed to allow low friction movement of the balls 12 along its surface. The balls 12 can traverse that surface until reaching the ball passage 56, which can also be described as a ball release point 56, wherein the ball 12 will move onto the transfer path 50 and onto the throwing machine 14.

The ball feeder 10 can further include a gear 58 operatively attached to the housing 40 and the drive mechanism 34. The drive mechanism 34 and gear 58 can rotate the housing 40 about the support rod 36. In this embodiment, each ball holding section 42 can include a ball holding axis 43 that is substantially parallel to the ball holding section axis of adjacent ball holding sections. Further, the each axis 43 can be substantially parallel to the support rod axis 37 of the support rod 36. Further, the support rod 36 can suspend the housing 40 from the support frame 32 to allow the housing 40 to rotate about the support rod 36.

In a preferred embodiment, each ball holding section 42 includes at least one ball indexing element 52. This ball indexing element 52 can include a first aperture 60 positioned in the wall 44 proximate to the exit opening 48. The first aperture 60 can be sized and shaped to accept a portion of one of the hemispheres 24 of the balls 12 and restrict movement of that ball 12 within that ball holding section 42.

Figure 9:
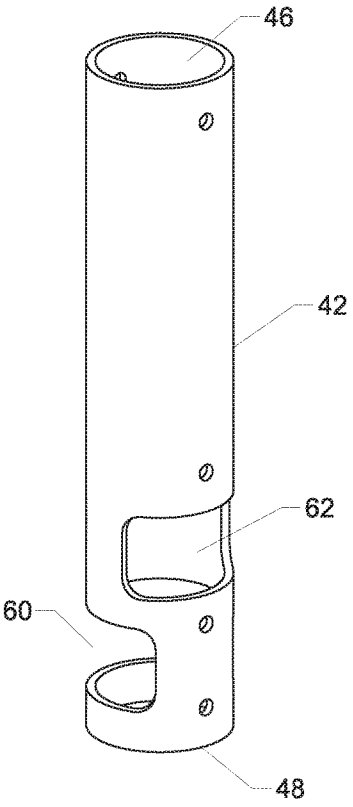
FIG. 9 is a detailed view of a ball holding section made in accordance with the current disclosure.

In another embodiment, the ball indexing element includes a second aperture 62 positioned in the wall 44 at a location that is axially closer to the entry opening 46 than the first aperture 60. Further, the second aperture 62 is positioned on a portion of the wall 44 that is approximately opposite the first aperture 60. Alternately stated, the second aperture 62 can be positioned on the wall 44 opposite the first aperture 60 and in a position along the axis of the ball holding section 42 at a location that is closer to the entry opening 46 than the first aperture 60. This positioning can be seen in FIGS. 9, 11, and 13. The second aperture 62 can also be sized and shaped to accept a portion of one of the hemispheres 24 of one of the balls 12 and restrict the movement of that ball 12 within that ball holding section 42.

Figure 4:
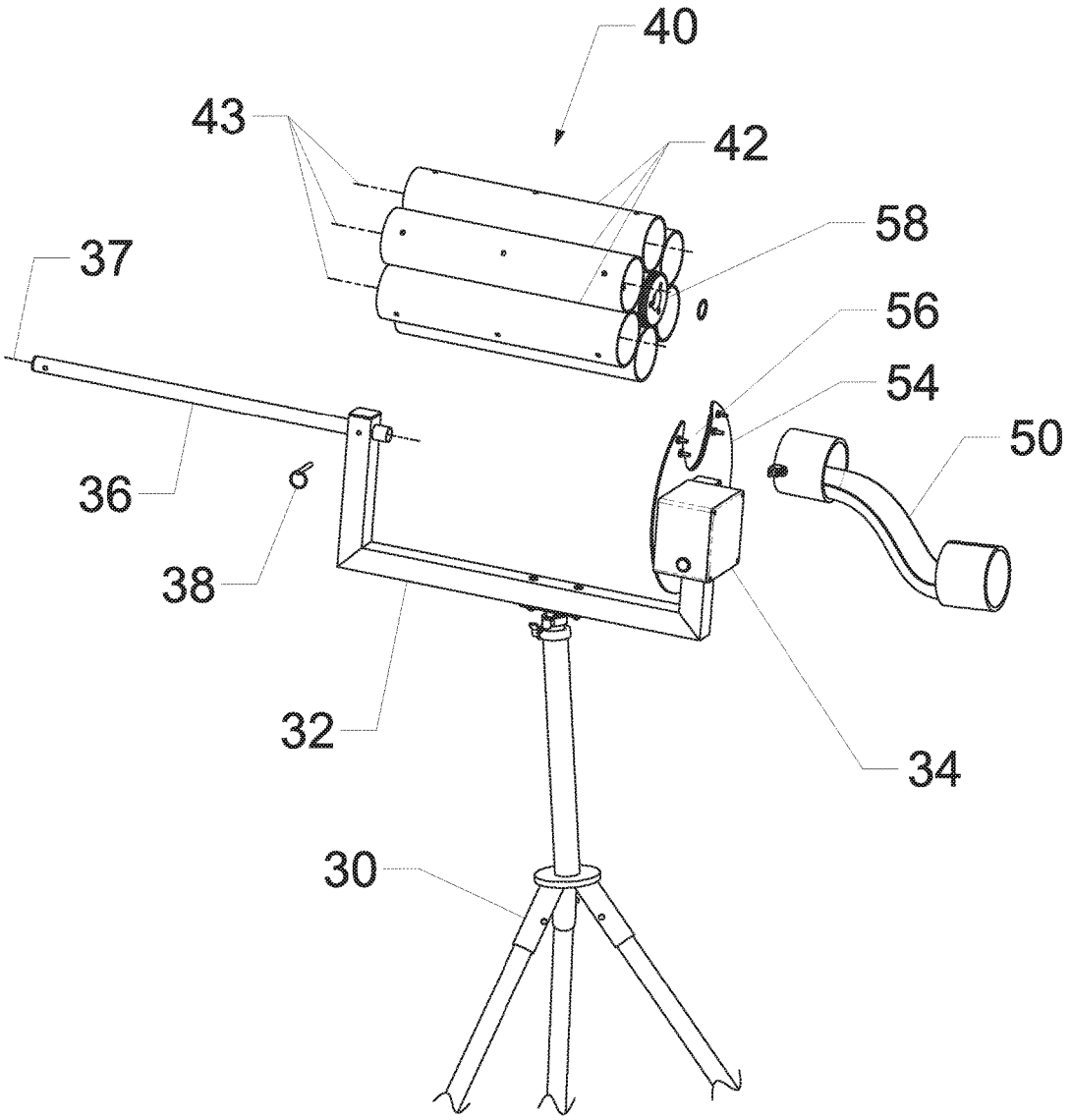
FIG. 4 is an expanded view of a portion of a game ball feeder as shown in FIGS. 2-3.
Figure 5:
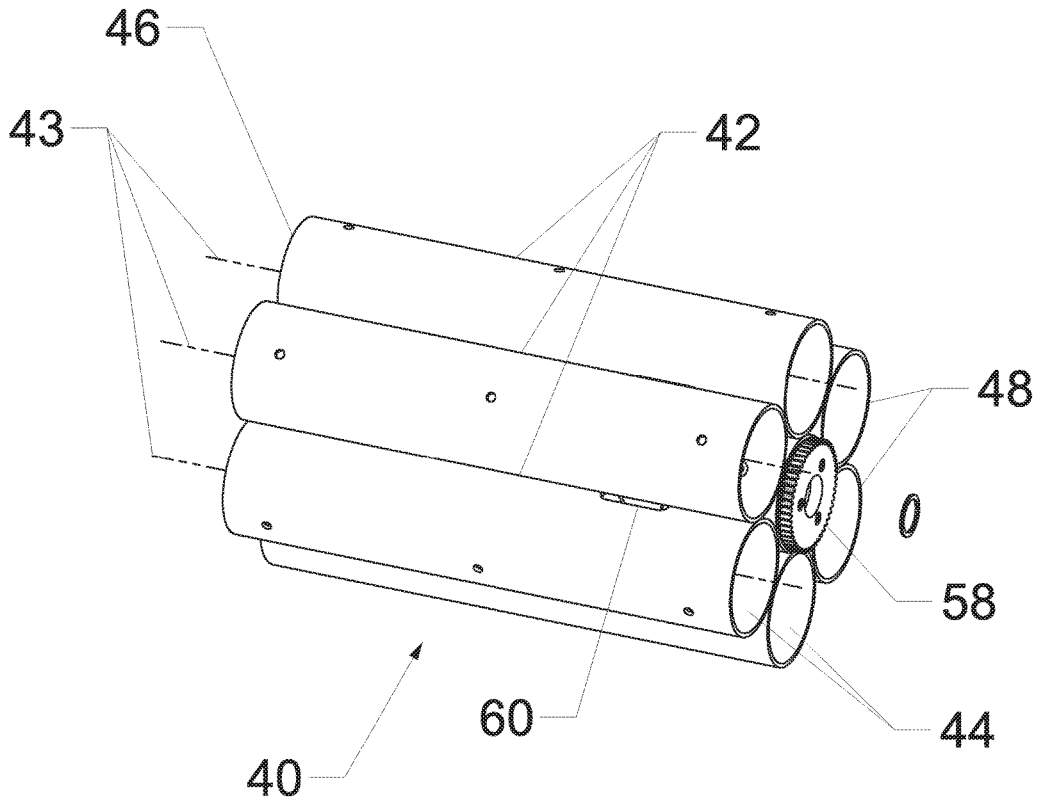
FIG. 5 is a detailed view of a rotatable ball housing made in accordance with the current disclosure.
Figure 6:
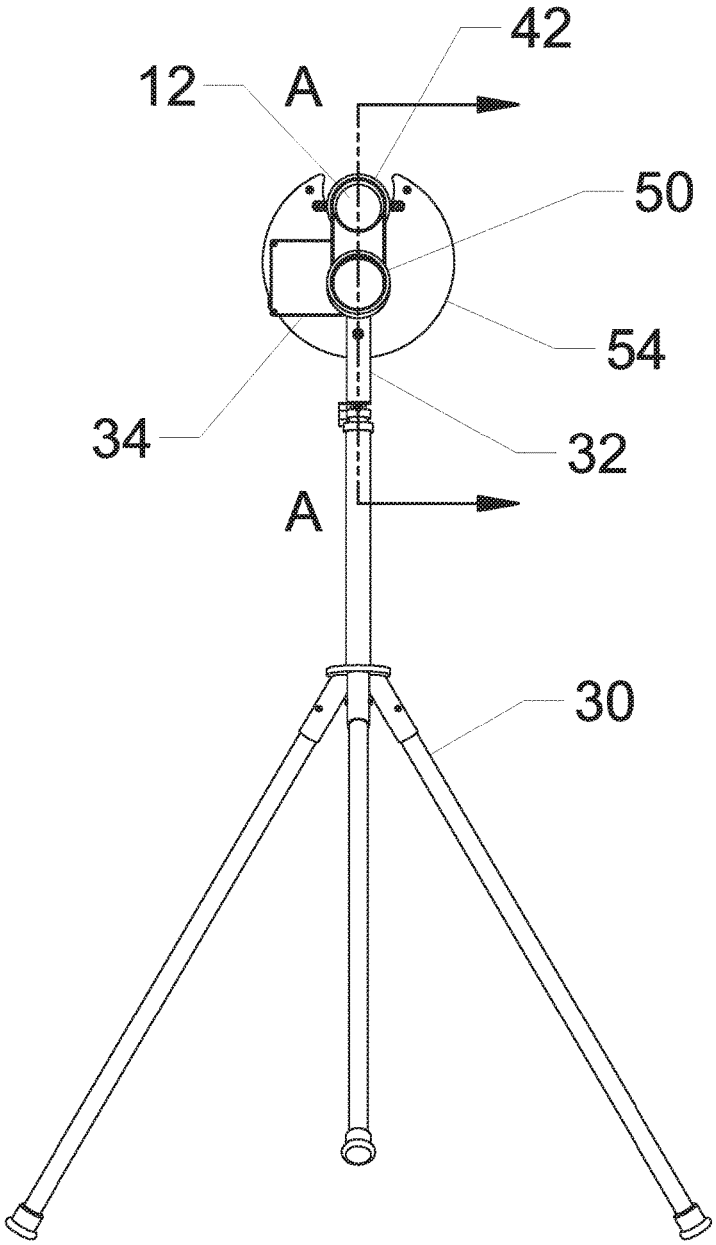
FIG. 6 is a front view of a game ball feeder made in accordance with the current disclosure.

Referring now to FIG. 4, an expanded view of a ball feeder 10 made in accordance with the current disclosure is shown. This partial expanded view shows the housing 40 and a preferred location of the gear 58. The gear 58 can be located at other spots on the housing 40 as desired and possible with known engineering techniques. The support rod 36 is shown passing through the support frame 32 and can extend through the housing 40 and through the gear 58 to engage the opposite end of the support frame 32. A pin 38 can be used to secure the support rod and position it on the support frame 32. The drive mechanism 34 can have various controls, including timers and frequency controls, as known in the art to deliver the balls 12 in a desired fashion, including the frequency of the delivery of the balls 12. The transfer path 50 can be attached to the plate 54 using conventional fasteners as known. Further, the plate 54 can be attached to the frame 32 proximate the drive mechanism 34.

Figure 7:
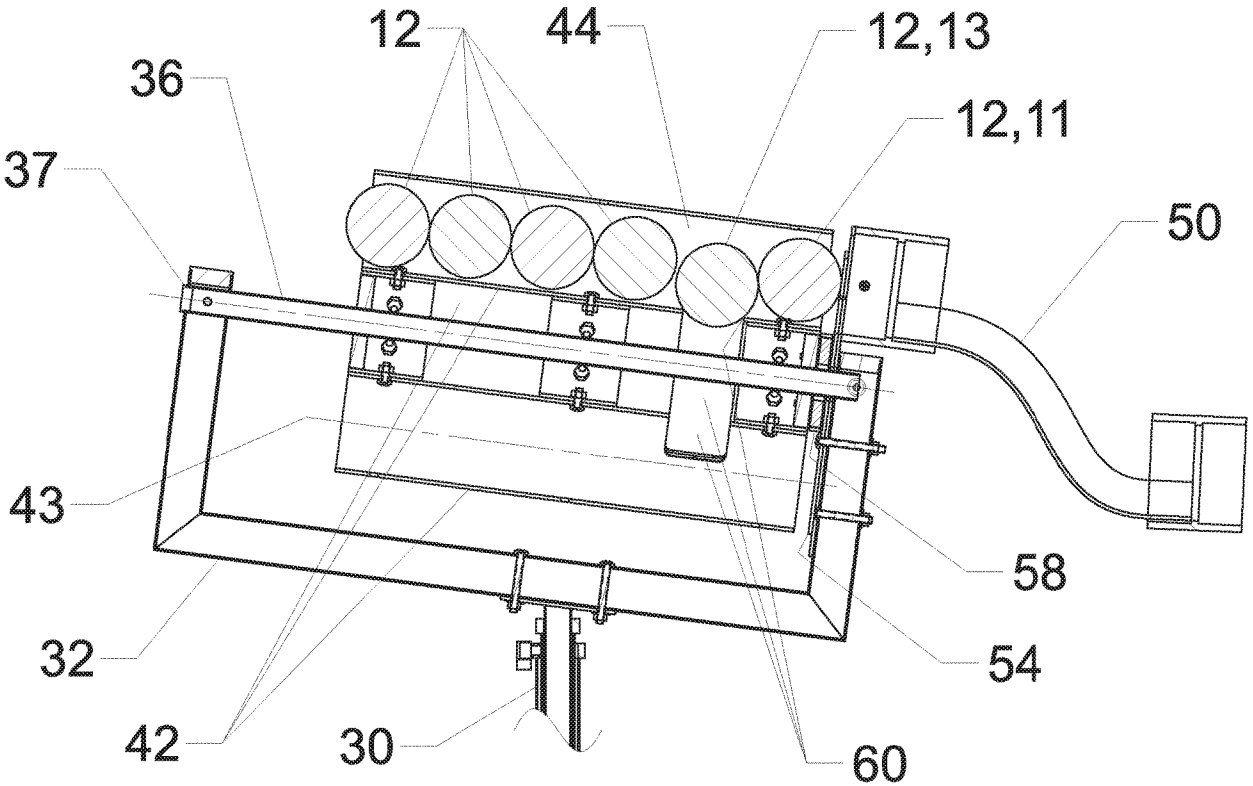
FIG. 7 is a cross sectional view taken along line A-A in FIG. 6.
Figure 8:
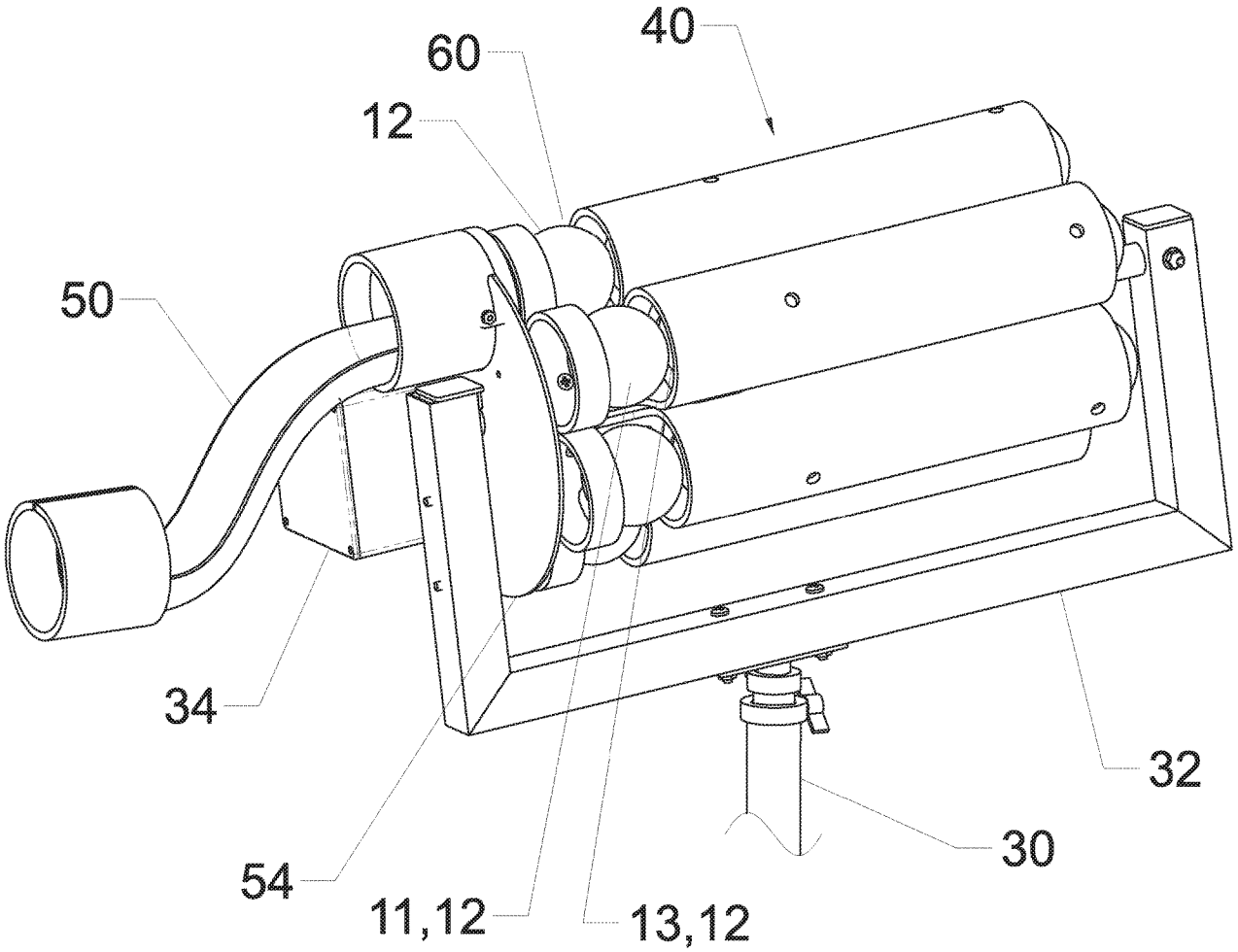
FIG. 8 is a perspective view of an alternate game ball feeder made in accordance with the current disclosure.

In operation, the ball feeder 10 can be rotated about the axis of the housing 40, which can coincide with the support rod axis 37 as generally seen in FIG. 7. Since the entry opening 46 is positioned vertically higher than the exit opening 48 in the ball holding sections 42, gravity will move the balls 12 from entry opening 46 to exit opening 48. One of the ball indexing elements 52, shown as a first aperture 60, will "catch" one of the balls 12 and hold that ball at the first aperture 60 when the rotation of the housing 40 has moved that first aperture 60 to a position where gravity will tend to pull the ball 12 through the aperture 60. As shown in FIG. 7, this occurs when this aperture 60 is at the bottom of the ball holding section 42, as shown when that ball holding section 42 has rotated to the top of the housing 40. This movement of the housing 40 can be described as a partial rotation of the housing 40 by the drive mechanism 34. This rotation engages that ball in the first aperture 60 to restrict movement of that ball in that ball holding section 42.

A continued rotation of the housing will cause that particular ball holding section 42 to rotate around the support rod and end up in a position that is below the support rod 36. This position will cause the ball to fall out of the first aperture 60 by gravity and roll towards the exit opening 48. At the exit opening 48 the plate 54 will engage the ball and keep it from completely rolling out of the housing and maintain it in a position to be placed in the ball passage 56 and ultimately into the transfer path 50. The remainder of the balls 12 behind will index a distance approximately equal to a circumference of the ball closer to the exit opening 48.

In a preferred embodiment the first aperture 60 is spaced from the exit opening 48 approximately a distance that is approximately equal to the length of the circumference of the ball at or near its equator—or one rotation of the ball. This movement allows the balls to index one "spot", or ball location, closer to the exit opening 48. Additionally, as the housing 40 rotates back up such that this particular ball holding section is at the top, the next ball in line will fall into the first aperture 60 while the ball that is past the aperture 60 will move out the ball passage 56 into the transfer path 50 and on to the throwing machine 14.

Figure 11:
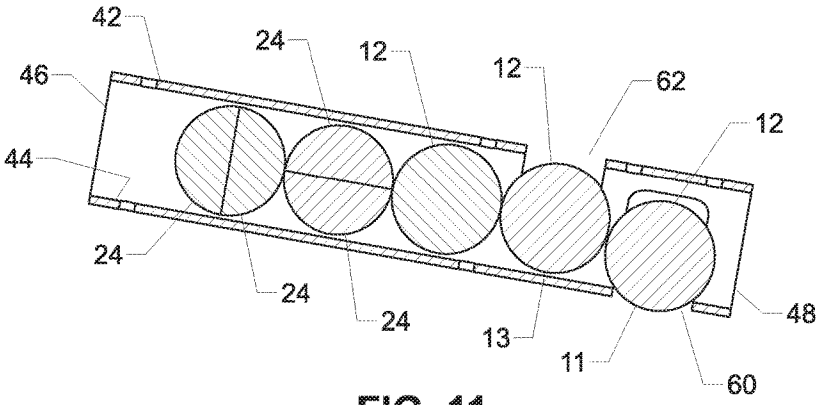
FIG. 11 is a cross sectional view taken along line C-C in FIG. 10.
Figure 13:
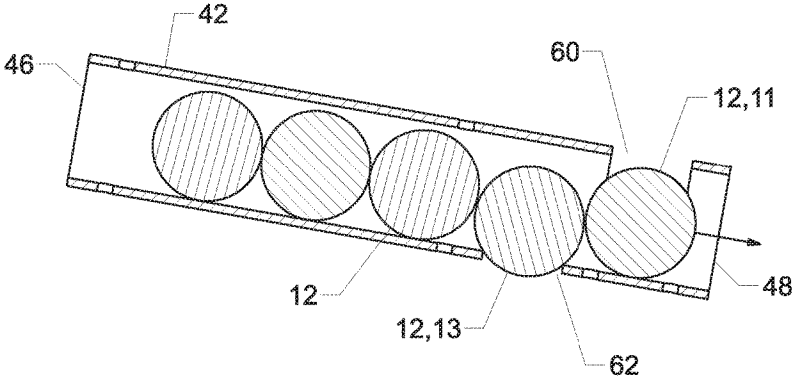
FIG. 13 is a cross sectional view taken along line D-D in FIG. 12.
Figure 10:
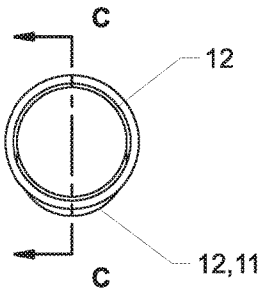
FIG. 10 is an end view of a ball holding section loaded with balls in a first position after a first partial rotation.
Figure 12:
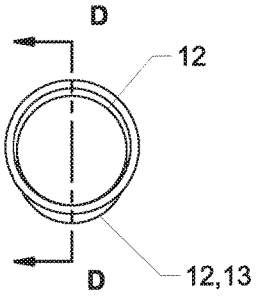
FIG. 12 is an end view of the ball holding section shown in FIGS. 9-11 after a second rotation of the rotatable ball housing.

In another embodiment as seen in FIGS. 8-13, the indexing element 52 can have first and second apertures 60 and 62. In operation, the housing 40 will rotate such that a first ball 11 is positioned in the first aperture 60. This first aperture restricts movement of the first ball along the ball holding section 42, and in turn restricts the movement of other balls along the ball holding section 42. This is best seen in FIGS. 10 and 11. As the housing continues to rotates, which can be described as a second partial rotation, the first ball 11 will disengage from the first aperture 60 which will allow movement of that ball 11 in the ball holding section 42 towards the exit opening 48. This second rotation will preferably cause an engagement of a second ball 13 in the second aperture 62. This rotation and engagement of the second ball 13 and the second aperture 62 will restrict the movement of the second ball 13 and subsequent balls higher and further along the ball holding section 42, as seen in FIGS. 12 and 13. Further, a third partial rotation, which can bring the ball holding section 42 back to the position as shown in FIG. 11, will index the second ball into the first aperture 60 and the remaining balls will follow along the ball holding section 42.

In this embodiment each partial rotation of the housing 40, which can be substantially a half turn of the housing 40, will index the second ball located in the ball holding section 42 into the first aperture 60 of that ball holding section 42. Once that position is established, the rotation of that ball holding section 42, which can be substantially a half turn of the housing 40, will index that second ball into a position to be moved out the ball passage 56 and into the transfer path 50. This subsequent half rotation of the housing 40 will index further balls aligned in the holding section into the second aperture 62. At that point the process will repeat itself with each half rotation resulting in an indexing of a ball from the second aperture 62 into the first aperture 60, with the subsequent half rotation indexing that ball from the first aperture 60 to a spot to be ejected out the ball passage 56 and to the transfer path 50.

Thus, although there have been described particular embodiments of the present disclosure of a new and useful AUTOMATIC GAME BALL FEEDER it is not intended that such references be construed as limitations upon the scope of this disclosure except as set forth in the following claims.

What is claimed is:

1. A game ball feeder for delivering balls to a game ball throwing machine, each ball including two hemispheres, the game ball feeder comprising:

a base;

a support frame attached to the base;

a drive mechanism attached to the support frame;

a support rod attached to the support frame;

a rotatable ball housing operatively engaging the support rod and mounted in a substantially horizontal configuration, the housing including a plurality of cylindrically shaped ball holding sections, each ball holding section including: a wall defining an entry opening and an exit opening, wherein the entry opening is positioned vertically higher that the exit opening, wherein both openings are shaped and sized to accept and pass at least one of the balls, a first aperture positioned in the wall between the entry opening and the exit opening, the first aperture sized and shaped to only accept a portion of one of the hemispheres of one of the balls and restrict the axial movement of that ball within that ball holding section;

a transfer path operatively attached to the support frame and aligned to accept a ball from one of the exit openings and direct that ball to the game ball throwing machine;

a partial rotation of the rotatable ball housing by the drive mechanism wherein the partial rotation engages a first ball in the first aperture to restrict movement of that ball in the ball holding section;

a continued rotation of the rotatable ball housing wherein the continued rotation disengages the first ball from the first aperture to allow movement of that ball in the ball holding section toward the transfer path; and a gear operatively attached to the rotatable ball housing and the drive mechanism, wherein the drive mechanism and the gear rotate the rotatable ball housing about the support rod.

2. The game ball feeder of claim 1, further including a reduced friction plate attached to the support frame, the plate including a ball passage aligned with the transfer path, the ball passage shaped to allow movement of at least one of the balls from one of the exit openings to the transfer path, the plate shaped and positioned to restrict movement of balls from the remainder of the exit openings.

3. The game ball feeder of claim 1, further including a second aperture positioned in the wall axially closer to the entry opening than the first aperture and on a portion of the wall approximately opposite the first aperture, the second aperture sized and shaped to only accept a portion of one of the hemispheres of one of the balls and restrict the movement of that ball within that ball holding section.

4. The game ball feeder of claim 3, wherein a first partial rotation of the rotatable ball housing by the drive mechanism engages the first ball in the first aperture to restrict axial movement of the first ball in the ball holding section; a second partial rotation of the rotatable ball housing disengages the first ball from the first aperture to allow movement of the first ball in the ball holding section toward the transfer path; the second partial rotation of the rotatable ball housing engages a second ball in the second aperture to restrict movement of the second ball in the ball holding section toward the transfer path; and a third partial rotation of the rotatable ball housing by the drive mechanism engages the second ball in the first aperture to restrict movement of the second ball in the ball holding section, wherein the third partial rotation is substantially similar in movement and duration to the first partial rotation.

5. The game ball feeder of claim 3, wherein the first aperture and the second aperture form an indexing element.

6. The game ball feeder of claim 1, wherein each ball holding section includes a ball holding section axis, each ball holding section axis is substantially parallel to the ball holding section axis of adjacent ball holding sections and substantially parallel to the support rod.

7. A game ball feeder for delivering balls to a game ball throwing machine, each ball including two hemispheres, the game ball feeder comprising:

a base;

a support frame attached to the base;

a drive mechanism attached to the support frame;

a support rod attached to the support frame;

a rotatable ball housing operatively engaging the support rod and mounted in a substantially horizontal configuration, the housing including a plurality of cylindrically shaped ball holding sections, each ball holding section including: a wall defining an entry opening and an exit opening, the entry opening positioned vertically higher than the exit opening, and both openings shaped and sized to accept and pass at least one of the balls, a first aperture positioned in the wall between the entry opening and the exit opening, the first aperture sized and shaped to only accept a portion of one of the hemispheres of one of the balls and restrict the axial movement of that ball within that ball holding section, and a second aperture positioned in the wall axially closer to the entry opening than the first aperture and on a portion of the wall approximately opposite the first aperture, the second aperture sized and shaped to only accept a portion of one of the hemispheres of one of the balls and restrict the movement of that ball within that ball holding section;

a transfer path operatively attached to the support frame and aligned to accept a ball from one of the exit openings and direct that ball to the game ball throwing machine;

a first partial rotation of the rotatable ball housing by the drive mechanism wherein the first partial rotation engages a first ball in the first aperture to restrict axial movement of the first ball in the ball holding section;

a second partial rotation of the rotatable ball housing wherein the second partial rotation disengages the first ball from the first aperture to allow movement of the first ball in the ball holding section toward the transfer path, wherein the second partial rotation of the rotatable ball housing engages a second ball in the second aperture to restrict axial movement of the second ball in the ball holding section toward the transfer path;

a third partial rotation of the rotatable ball housing by the drive mechanism wherein the third partial rotation engages the second ball in the first aperture to restrict movement of the second ball in the ball holding section, wherein the third partial rotation is substantially similar in movement and duration to the first partial rotation; and a gear operatively attached to the rotatable ball housing and the drive mechanism, wherein the drive mechanism and the gear rotate the rotatable ball housing about the support rod.

8. The game ball feeder of claim 7, further including an end plate attached to the support frame, the end plate including a ball passage aligned with the transfer path, the ball passage shaped to allow movement of at least one of the balls from one of the exit openings to the transfer path, the end plate shaped and positioned to restrict movement of balls from the remainder of the exit openings.

9. The game ball feeder of claim 7, wherein each ball holding section includes a ball holding section axis, each ball holding section axis is substantially parallel to the ball holding section axis of adjacent ball holding sections and substantially parallel to the support rod.

10. The game ball feeder of claim 7, wherein the first aperture and the second aperture form an indexing element.

* * * * *